US010132011B2

(12) United States Patent
Malina et al.

(10) Patent No.: US 10,132,011 B2
(45) Date of Patent: Nov. 20, 2018

(54) SUCTION DRUM WITH SEAL

(71) Applicant: Maschinenfabrik Rieter AG, Winterthur (CH)

(72) Inventors: Ludek Malina, Kloten (CH); Robert Nägeli, Kleinandelfingen (CH); Gabriel Schneider, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 366 days.

(21) Appl. No.: 15/021,315

(22) PCT Filed: Sep. 1, 2014

(86) PCT No.: PCT/IB2014/001657
§ 371 (c)(1),
(2) Date: Mar. 11, 2016

(87) PCT Pub. No.: WO2015/036821
PCT Pub. Date: Mar. 19, 2015

(65) Prior Publication Data

US 2016/0222553 A1 Aug. 4, 2016

(30) Foreign Application Priority Data

Sep. 13, 2013 (CH) ..... 01572/13

(51) Int. Cl.
*D01H 5/72* (2006.01)

(52) U.S. Cl.
CPC ..... *D01H 5/72* (2013.01)

(58) Field of Classification Search
CPC ..... D01H 5/72
See application file for complete search history.

(56) References Cited

U.S. PATENT DOCUMENTS 3,999,365 A * 12/1976 Suzuki ..... D01H 4/12 188/249
4,858,422 A 9/1989 Stahlecker
(Continued)

FOREIGN PATENT DOCUMENTS

CH 705843 A1 6/2013
DE 834219 3/1952
(Continued)

OTHER PUBLICATIONS

CH Search Report, dated Dec. 2, 2013.
PCT International Search Report, dated Nov. 19, 2014.

*Primary Examiner* — Shaun R Hurley
(74) *Attorney, Agent, or Firm* — Dority & Manning, P.A.

(57) ABSTRACT

A rotatably mounted suction drum (14) of a device (VM) for compacting a fiber material (V) on a spinning machine having an annular drive element (20) which, in the operating position, rests via a portion of its inner surface (IF) on a portion of a circular peripheral surface (AU) of a projection (13) that extends coaxial to an axis of rotation (A1) of the suction drum (14) and is mounted on an end face (35) of the suction drum (14). In order to prevent fibers detached from the fiber material (V) from settling between the inner surface (IF) of the drive element (20) and the peripheral surface (AU) of the projection (13), the suction drum (14), on the end face (35) having the projection (13), has a peripheral elevation (36) and the drive element (20) on the side (46) directed toward the end face (35) of the suction drum (14) has a peripheral recess (37), wherein the elevation (36) protrudes into the recess (37) a labyrinth seal.

8 Claims, 5 Drawing Sheets

(56) References Cited

U.S. PATENT DOCUMENTS

| | | | | | |
|---|---|---|---|---|---|
| 5,465,567 | A * | 11/1995 | Schmolke | D01G 19/105 | 19/112 |
| 5,594,606 | A * | 1/1997 | Hans | G11B 19/2009 | 310/67 R |
| 5,867,974 | A | 2/1999 | Schmid | | |
| 5,887,417 | A * | 3/1999 | Derichs | D01H 4/12 | 57/404 |
| 5,941,058 | A * | 8/1999 | Wassenhoven | D01H 4/32 | 57/406 |
| 5,950,415 | A * | 9/1999 | Stahlecker | D01H 4/32 | 57/408 |
| 2009/0038576 | A1* | 2/2009 | Schermer | D01H 4/32 | 123/193.2 |
| 2013/0239721 | A1 | 9/2013 | Schneider et al. | | |
| 2015/0027098 | A1* | 1/2015 | Nageli | D01H 5/72 | 57/315 |
| 2017/0073851 | A1* | 3/2017 | Schneider | D01H 5/72 | |

FOREIGN PATENT DOCUMENTS

| | | |
|---|---|---|
| DE | 1075026 | 2/1960 |
| DE | 1140498 | 11/1962 |
| DE | 3316656 | 11/1984 |
| DE | 19651417 A1 | 6/1998 |
| DE | 19947418 | 4/2001 |
| DE | 10 2004 052511 | 4/2006 |
| WO | WO 2012/068692 A1 | 5/2012 |

* cited by examiner

SUCTION DRUM WITH SEAL

FIELD OF INVENTION

The invention relates to a rotatably mounted suction drum of a device for compacting a fiber material on a spinning machine having an annular drive element which, in the operating position, rests via a portion of its inner surface on a portion of a circular peripheral surface of a projection which extends coaxial to an axis of rotation of the suction drum and is mounted on an end face of the suction drum.

BACKGROUND OF THE INVENTION

WO 2012068692 A1 describes a device for compacting a fiber material on a spinning machine, which device is intended for retrofitting on a conventional drafting system unit of the spinning machine. The device is disposed downstream of the drafting system unit of the spinning machine and is used to compact a fiber material discharged by the drafting system unit. Following the compaction device, the compacted fiber material, after passing through a nip point, is fed to a twist generation device. The twist generation device in a ring spinning machine, for example, consists of a traveler which revolves on a ring, wherein the yarn produced is wound onto a rotating tube.

The compaction device described in WO 2012068692 A1, for use on the usual twin drafting systems on ring spinning machines, comprises two driven and revolving suction drums which are acted upon by suction air and are rotatably supported on a support in an axially parallel manner and spaced from each other. Therefore, two suction drums are assigned as a unit (module) to one twin drafting system. The support comprises a suction channel connected to a negative pressure source, which suction channel is connected to the interior of the suction drums via appropriate inserts. The inserts are provided with appropriately shaped suction slits, whereby a corresponding air flow is generated at the periphery of the particular suction drum in a compaction zone. Protruding fibers are incorporated into the fiber material by means of this air flow which is oriented substantially transversely to the direction of transport of the fiber material.

Assigned to each of the suction drums is an annular drive element in the form of a friction wheel which rests via its circular inner surface, under the effect of a pressure load, on a portion of the circular peripheral surface of a projection disposed on the end face of the particular suction drum. The rotational motion of the friction wheel driven by friction on the outer periphery is transmitted to the peripheral surface of the projection which is connected to the suction drum. The friction wheel is driven via a frictional connection by the driven bottom delivery roller of the drafting system. Due to a closure cap fastened on the end of the projection, the friction wheel is held in position on the projection in the axial direction, wherein in the operating position, an axial gap is present between the end face of the suction drum and the friction wheel.

During the compaction process, individual fibers can detach from the fiber material to be compacted and settle on the periphery of the suction drum. These fibers can move in the direction of the end face of the suction drum and thereby pass into the axial gap between the end face of the suction drum and the friction wheel. The movement of fibers can be induced, for example, by the rotation of the suction drum or by the air flow produced by the rotation of the suction drum. There is a risk that fibers that pass into the axial gap will move to the outer periphery of the projection and adhere thereto. As a result, the inner surface of the friction wheel is no longer in direct contact with the outer periphery of the projection, whereby a continuous transmission of the drive torque from the friction wheel onto the suction drum is no longer ensured. As a result, the speed ratio between the suction drum and the bottom delivery roller of the drafting system changes. The fiber material to be compacted is therefore compressed in the compaction zone, which negatively affects the quality of the compaction of the fiber material. It is therefore necessary to move the drive element away from the suction drum after a certain operating time of the compaction device and remove the collected fibers from the outer periphery of the projection. This requires a great deal of maintenance effort and results in long downtimes of the spinning machine.

SUMMARY OF THE INVENTION

An object of the invention, therefore, is to design the suction drum of a device for compacting a fiber material on a spinning machine in combination with the drive element in such a way that fibers that detach, during the compaction process, from the fiber material to be compacted do not settle in the area of the outer periphery of the projection disposed on the end face of the suction drum. Additional objects and advantages of the invention will be set forth in part in the following description, or may be obvious from the description, or may be learned through practice of the invention.

The suction drum according to the invention can be used on a compaction device that is fixedly installed following the particular drafting system, or which is intended for retrofitting on a conventional drafting system unit. Within the scope of the present invention, a labyrinth seal is understood to be a preferably contactless seal which is achieved by a mutual engagement of shaped elements.

The objects are achieved in that the suction drum, on the end face having the projection, comprises at least one peripheral elevation and the drive element on the side directed toward the end face of the suction drum comprises at least one peripheral recess, wherein the at least one elevation protrudes into the at least one recess and the elevation and the recess together form a labyrinth seal. The peripheral elevation is a protrusion on the end face of the suction drum, which is annular and closed and extends coaxial to the projection of the suction drum. The shape of the peripheral recess is an image of the shape of the peripheral elevation and is designed as an annular groove matching the annular elevation.

The elevation and the recess interact in such a way that the opposing sealing surfaces, i.e., the inner surfaces of the recess and the outer surfaces of the elevation, form a narrow sealing gap. The sealing gap functions as a barrier against fibers that detach from the fiber material during the compaction process and pass into the axial gap between the suction drum and the drive element. In the axial gap, the fibers impact the elevation and are halted by this elevation. The labyrinth seal forces the fibers to undergo a change of direction which makes it nearly impossible for the fibers to pass through the sealing gap.

Due to the interaction of the elevation and the recess, it is possible to control the fiber flow in the axial gap between the suction drum and the drive element. Fibers are therefore prevented from flowing to the outer periphery of the projection disposed on the end face of the suction drum and settling there. It is thereby ensured that, during operation of the compaction device, the inner surface of the drive element has direct contact to the outer periphery of the projection of the suction drum. A continuous transmission of the drive torque from the drive element to the suction drum is therefore ensured. In contrast to the prior art, the compaction device can therefore be operated without a relatively great deal of maintenance effort. In order to further strengthen the seal, it is also possible that multiple peripheral elevations are disposed on the end face of the suction drum and the drive element therefore has multiple peripheral recesses on the side directed toward the end face of the suction drum, into which recesses the elevations engage.

It has proven advantageous for the at least one elevation of the suction drum to have a height of 1-5 mm, wherein the height is the axial extension of the elevation proceeding from the end face of the suction drum in the direction of the projection. Tests have shown that a height of the elevation in this area results in a strong sealing effect.

It is also advantageous if outside of the elevation and the recess, the end faces of the suction drum and of the drive element have a spacing of 0.1-0.5 mm. A narrow gap ensures that only a small portion of the detached fibers can pass into the gap. In the case of a wider gap, it is possible for fibers situated in the gap to autonomously come loose as a result of the rotation of the suction drum.

It is also advantageous if the at least one elevation forms a step-shaped projection between the peripheral surface of the projection and the end face of the suction drum, so that the projection extends from the axis of rotation, in the radial direction, from the outer periphery of the projection. The outer diameter of the projection is advantageously between 50-75% of the outer diameter of the suction drum. Tests have shown that a strong sealing effect is achieved by means of the step-shaped projection. In addition, a suction drum having a step-shaped projection can be produced easily and, therefore, at low cost.

It is also advantageous if the surface of the projection directed radially outward from the axis of rotation is disposed at an angle of 5-45° with respect to the axis of rotation, so that the outer diameter of the projection constantly decreases toward the end face of the suction drum. As a result of the conical configuration of the projection, a recess forms between the peripheral surface of the projection and the end face of the suction drum, in which recess the fibers can settle. Tests have shown that the sealing effect is strengthened further as a result.

Finally, it is advantageous if the drive element is rotationally symmetrical, so that the at least one recess is present on both end faces of the drive element. Incorrect installation of the drive element is thereby prevented.

BRIEF DESCRIPTION OF THE DRAWINGS

The invention is shown and described in greater detail with reference to the following exemplary embodiments. In the drawings.

DETAILED DESCRIPTION

Figure 1:
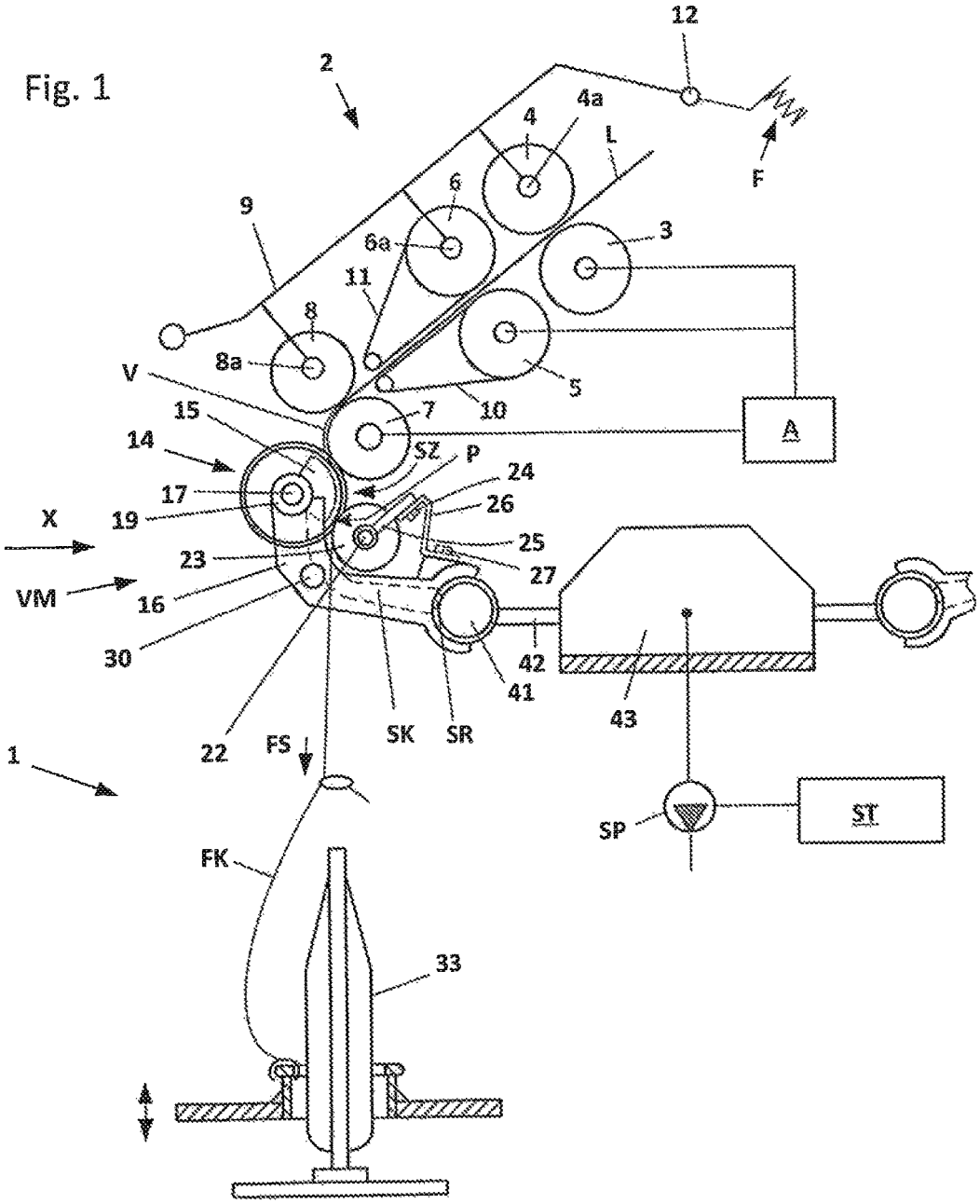
FIG. 1 shows a schematic side view of a spinning station of a ring spinning machine, having a drafting system unit and a subsequent compaction device.

Reference will now be made to the embodiments of the invention, one or more examples of which are shown in the drawings. Each embodiment is provided by way of explanation of the invention, and not as a limitation of the invention. For example features illustrated or described as part of the one embodiment can be combined with another embodiment to yield still another embodiment. It is intended that the present invention include these and other modifications and variations to the embodiments described herein.

FIG. 1 shows a schematic side view of a spinning station 1 of a spinning machine (ring spinning machine) comprising a drafting system unit 2, which is provided with a pair of feed rollers 3, 4, a pair of middle rollers 5, 6, and a pair of delivery rollers 7, 8. An apron 10, 11 is guided around the middle rollers 5, 6, respectively, each of which is held in its illustrated position around a cage, not shown in greater detail. The top rollers 4, 6, 8 of the mentioned roller pairs are designed as pressure rollers which are rotatably supported on a pivotably supported pressure arm 9 via the axles 4*a*, 6*a*, 8*a*. The pressure arm 9 is supported so as to be pivotable about an axle 12 and, as schematically illustrated, is acted on by a spring element F. The rollers 4, 6, 8 are pressed against the bottom rollers 3, 5 and 7, respectively, of the roller pairs via the schematically illustrated spring loading. The roller pairs 3, 5, 7 are connected to a drive A, as schematically indicated. The pressure rollers 4, 6, 8 are driven via the driven bottom rollers 3, 5, 7, and the apron 11 is driven via the apron 10, by friction. The peripheral speed of the driven roller 5 is slightly greater than the peripheral speed of the driven roller 3, so that the fiber material in the form of a roving L fed to the drafting system unit 2 is subjected to a break draft between the pair of feed rollers 3, 4 and the pair of middle rollers 5, 6. The main draft of the fiber material L results between the pair of middle rollers 5, 6 and the pair of delivery rollers 7, 8, wherein the delivery roller 7 has a significantly higher peripheral speed than the middle roller 5.

Figure 2:
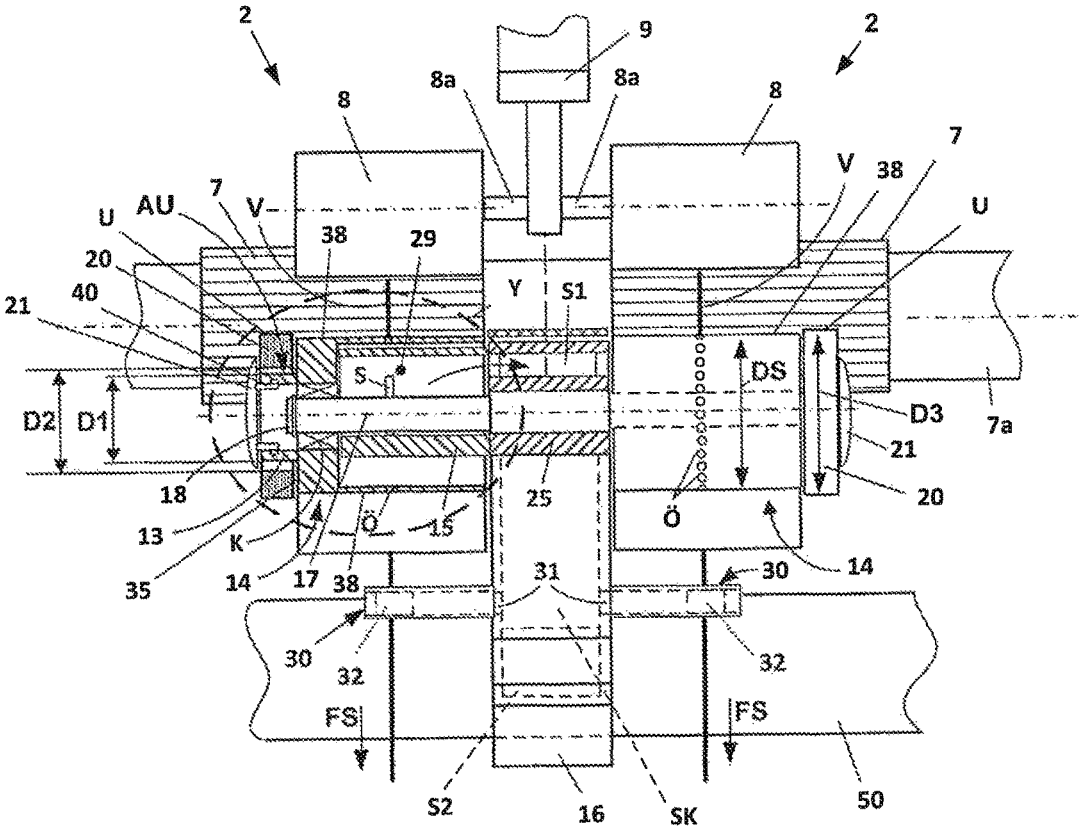
FIG. 2 shows an enlarged partial view X according to FIG. 1, having two adjacently situated drafting system units and two rotatably supported suction drums of a compaction device fastened on a carrier.

As is apparent from FIG. 2 (view X according to FIG. 1), a pressure arm 9 is associated with two adjacent drafting system units 2 (twin drafting system). Since the elements of the adjacent drafting system units 2 and of the compaction modules VM are the same or are disposed in mirror-image positions in some cases, the same reference numbers are used for these parts.

Following the drafting system unit 2, the spinning machine comprises a pivotably supported compaction module VM for compacting a fiber material V delivered by the drafting system unit 2. The compaction module VM has been retrofitted on the drafting system unit 2. The compaction module VM comprises two driven and revolving suction drums 14 which are acted upon by suction air and are rotatably supported on a support 16 in an axially parallel manner and spaced from each other. The support 16 comprises a suction channel SK connected to a negative pressure source SP, which suction channel is connected to the interior of the suction drums 14 via appropriate inserts 15. The compaction module VM is described in detail in WO 2012068692 A1.

The drafted fiber material V delivered by the pair of delivery rollers 7, 8 is deflected downwardly and passes into the area of a suction zone SZ of a subsequent suction drum 14. The particular suction drum 14 is provided with perforations or openings Ö on its periphery. A stationarily supported suction insert 15 is disposed in each case inside the rotatably supported suction drum 14. As schematically shown in FIG. 2, the particular suction insert 15 can be held in its installed stationary position by the carrier 16 via holding means, not shown in greater detail.

As schematically indicated, the particular suction insert 15 has a suction slit S (FIG. 2) on a portion of its periphery which extends essentially over the suction zone SZ. The particular suction drum 14 is rotatably supported in the area of its outer end on a shaft 17 via a bearing K. A retaining ring 18 which prevents the axial displacement of the suction drum 14 during operation is mounted on the shaft 17 for axially fixing the suction drum 14.

The shaft 17 is fastened in a receptacle 19 of the carrier 16. In the area of the receptacle 19, the shaft 17 has a slightly larger diameter, while the ends of the shaft 17 extending from this receptacle on both sides have a tapered diameter, and are used for accommodating the particular bearing K. On its end face 35, i.e. on the end facing away from the carrier 16, the particular suction drum 14 has an annular projection 13 having an outer diameter D1. A portion of the inner surface IF of an annular drive element 20 rests on a portion of the outer periphery AU of the projection 13, wherein the clearance of this inner surface IF has a diameter D2. The drive element 20 is designed as a friction wheel.

In the position shown in FIG. 2, the particular suction drum 14 is in a working position in which the outer periphery U of the drive element 20 having a diameter D3 rests on the outer periphery of the driven delivery roller 7 via a suitably applied pressure load. That is, the drive element 20 is driven in a first gear ratio via friction from the roller 7. Likewise, via friction, the friction wheel 20 transmits the drive in a second gear ratio to the annular projection 13 of the suction drum 14. This occurs at the point where the inner surface IF having the inner diameter D2 of the friction wheel 20, and the outer periphery AU of the projection 13 having the outer diameter D1 contact or rest against one another.

An embodiment (not shown) is also possible in which the annular drive element is provided on its outer periphery with toothing which is engaged with a toothing of the delivery roller 7, wherein the drive element has a clearance having an inner surface IF which rests on the planar outer surface AU of the projection 13, as shown in the example of FIG. 2. That is, the first gear ratio has an interlocked drive connection in this embodiment, while the second gear ratio is implemented via a friction connection.

As is apparent from FIG. 2, a closure cap 21 is fastened in the area of the annular projection 13, which closure cap protrudes via its outer diameter beyond the clearance D2 of the friction wheel 20. The closure cap 21 is provided with an annular projection 40 which protrudes into the clearance of the annular projection 13 of the suction drum 14. The outer diameter of the annular projection 40 is selected in such a way that, in the position shown in FIG. 2, it exerts a clamping effect inside the clearance of the projection 13. As schematically illustrated, the annular projection 40 can be provided with additional outwardly protruding cams which, for fixing the closure cap 21, engage in peripheral recesses inside the clearance of the projection 13. As a result of the closure cap 21, the friction wheel 20 is held in position on the projection 13 in the axial direction, wherein in the operating position, an axial gap is present between the end face 35 of the suction drum 14 and the drive element 20.

During the compaction process, individual fibers can detach from the fiber material V to be compacted and settle on the periphery 38 of the suction drum 14. These fibers can move in the direction of the end face 35 of the suction drum 14 and thereby pass into the axial gap between the end face 35 of the suction drum 14 and the friction wheel 20. The movement of fibers can be induced, for example, by the rotation of the suction drum 14 or by the air flow produced by the rotation of the suction drum 14. There is a risk that fibers that pass into the axial gap will move to the outer periphery AU of the projection 13 and adhere thereto. As a result, the inner surface IF of the friction wheel 20 is no longer in direct contact with the outer periphery AU of the projection 13, whereby a continuous transmission of the drive torque from the friction wheel 20 onto the suction drum 14 is no longer ensured. As a result, the speed ratio between the suction drum 14 and the bottom delivery roller 7 of the drafting system 2 changes. The fiber material V to be compacted is therefore compressed in the compaction zone SZ, which negatively affects the quality of the compaction of the fiber material V. It is therefore necessary to move the friction wheel 20 away from the suction drum 14 after a certain operating time of the compaction device VM and remove the collected fibers from the outer periphery AU of the projection 13. This requires a great deal of maintenance effort and results in long downtimes of the spinning machine.

As is apparent from FIG. 2, two suction drums 14 of adjacent spinning stations are rotatably supported on the shaft 17 fastened on the carrier 16. The suction drums 14 together with a respective friction wheel 20 are disposed in a mirror image with respect to the carrier 16.

Following the suction zone SZ, for each of the suction drums 14, a nip roller 23 is provided, which rests on the particular suction drum 14 via a pressure load and, with this suction drum, forms a nip line P. The particular nip roller 23 is rotatably supported on an axle 22 which is fastened on a bearing element 25 connected to a spring element 26 via screws 27. The spring element 26, via which a contact force of the nip roller 23 is generated in the direction of the suction drum 14, is fastened on the carrier 16 via the schematically illustrated screws 27. At the same time, the nip line P forms a so-called "twist stop" from which the fiber material is fed, in the conveying direction FS in the form of a compacted yarn FK with imparting of a twist, to a schematically illustrated ring spinning device 1.

Extending within the carrier 16 is a suction channel SK which has an opening S2 on the inner surface of the end piece of the carrier 16, and a further opening S1 which is disposed in the area of the receptacle 19 and is connected to the interior 29 of the particular suction insert 15. In the working position, the opening S2 is disposed opposite an opening SR in the suction tube 41, whereby the interior of the suction tube 41 is connected to the suction channel SK. As is apparent from FIG. 1, the suction tube 41 is connected to a central main channel 43 via one or more connecting channels 42. This channel 43 is connected to a negative pressure source SP which can be controlled via a control unit ST.

In the event of a thread break between the nip line P and the spool 33, to be able to suction yarn FK that is further delivered via the nip point P, a suction tube 30 is fastened to each side of the carrier 16, whose respective opening 31 facing the carrier 16 is connected to the channel SK. The outwardly protruding end, viewed from the carrier 16, of the particular suction tube 30 is closed. An opening 32 which points in the direction of the downwardly pulled yarn FK is provided on a portion of the periphery of the particular suction tube 30. That is, if a thread break occurs, via the suction channel SK, the end of the further delivered thread or yarn is fed to the suction tube 30 via the particular suction tube 30 under the action of the negative pressure generated via the negative pressure source SP, and the suction tube delivers the thread or yarn via the channel(s) 42 to the main channel 43 for further supply to a collection station.

Figure 3:
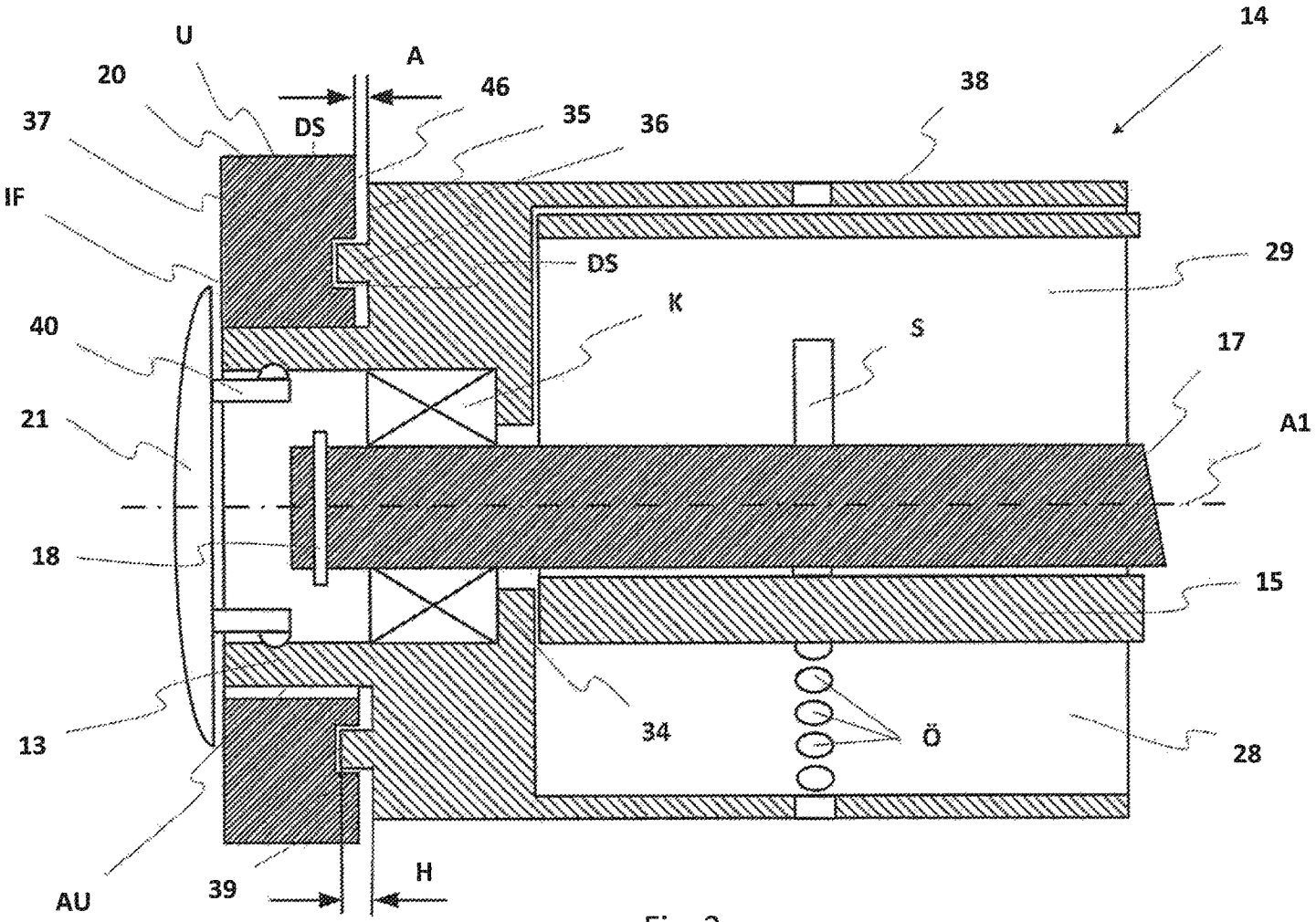
FIG. 3 shows an enlarged partial view Y, according to FIG. 2, of a suction drum designed according to the invention and of a drive element.

FIG. 3 shows an enlarged partial view Y according to FIG. 2 of an exemplary embodiment of a suction drum 14, according to the invention, having a drive element 20. The suction drum 14 has an annular elevation 36 on its end face 35. The elevation 36 extends coaxial to the projection 13 of the suction drum 14 and, viewed from the axis of rotation (A1), is disposed with radial spacing from the outer periphery AU of the projection 13. The elevation 36 has a height H of 1-5 mm. The height H extends in the axial direction toward the suction drum 14. Conversely, the drive element 20, on its end face 46 facing the end face 35 of the suction drum 14, has an annular recess 37 into which the elevation 36 protrudes. The elevation 36 and the recess 37 interact in such a way that the sealing surfaces, which are disposed opposite one another in the axial and the radial direction, form a narrow sealing gap DS. The sealing gap DS (labyrinth seal) functions as a barrier against fibers that have detached, during the compaction process, from the fiber material V to be compacted and have passed into the axial gap A between the end face 35 of the suction drum 14 and the end face 46 of the drive element 20. In the axial gap A, the fibers impact the elevation 36 and are halted by this elevation. The labyrinth seal forces the fibers to undergo a change of direction, which makes it nearly impossible for the fibers to pass through the sealing gap DS.

In contrast to the prior art (FIG. 2), the fiber flow in the axial gap A is controlled via the interaction of the annular elevation 36 and the annular recess 37. In the case of a larger gap A, e.g., of 0.5 mm, fibers located in the gap A can also move outward again in the direction toward the peripheral surface 38 of the suction drum 14. Fibers are therefore prevented from passing to the outer periphery AU of the projection 13 and settling there. It is thereby ensured that, during operation of the compaction device VM, the inner surface IF of the drive element 20 has direct contact to the outer periphery AU of the projection 13. A continuous transmission of the drive torque from the drive element 20 to the suction drum 14 is therefore ensured. In contrast to the prior art, the compaction device VM can therefore be operated without a relatively great deal of maintenance effort.

The suction drum 14 has an anodized coating and is provided with perforations or openings Ö extending on its periphery. The openings Ö form a hole pattern in one row. A stationarily supported suction insert 15 having a suction slit S on a portion of its periphery is disposed in the interior 28 of the suction drum 14. The suction insert 15 is held in its installed stationary position on a carrier 16 (FIG. 2) via holding means, not shown in greater detail. The suction drum 14 is rotatably supported in the area of its outer end on a shaft 17 via a bearing K, wherein the bearing K rests against a stop 34 of the suction drum 14 and is mounted from the outer end of the suction drum 14. A retaining ring 18 which prevents the axial displacement of the suction drum 14 during operation is mounted on the shaft 17 for axially fixing the suction drum 14. It is also possible that the suction drum 14 is fastened on the shaft 17 in a rotationally fixed manner, and the shaft 17 is rotatably supported.

A transparent closure cap 21 is fastened in the area of the annular projection 13, which closure cap protrudes via its outer diameter beyond the clearance D2 of the friction wheel 20. The closure cap 21 is provided with an annular projection 40 which protrudes into the clearance of the annular projection 13 of the suction drum 14. The annular projection 40 is provided with additional outwardly protruding cams which, for fixing the closure cap 21, engage in peripheral recesses within the clearance of the projection 13.

Figure 4:
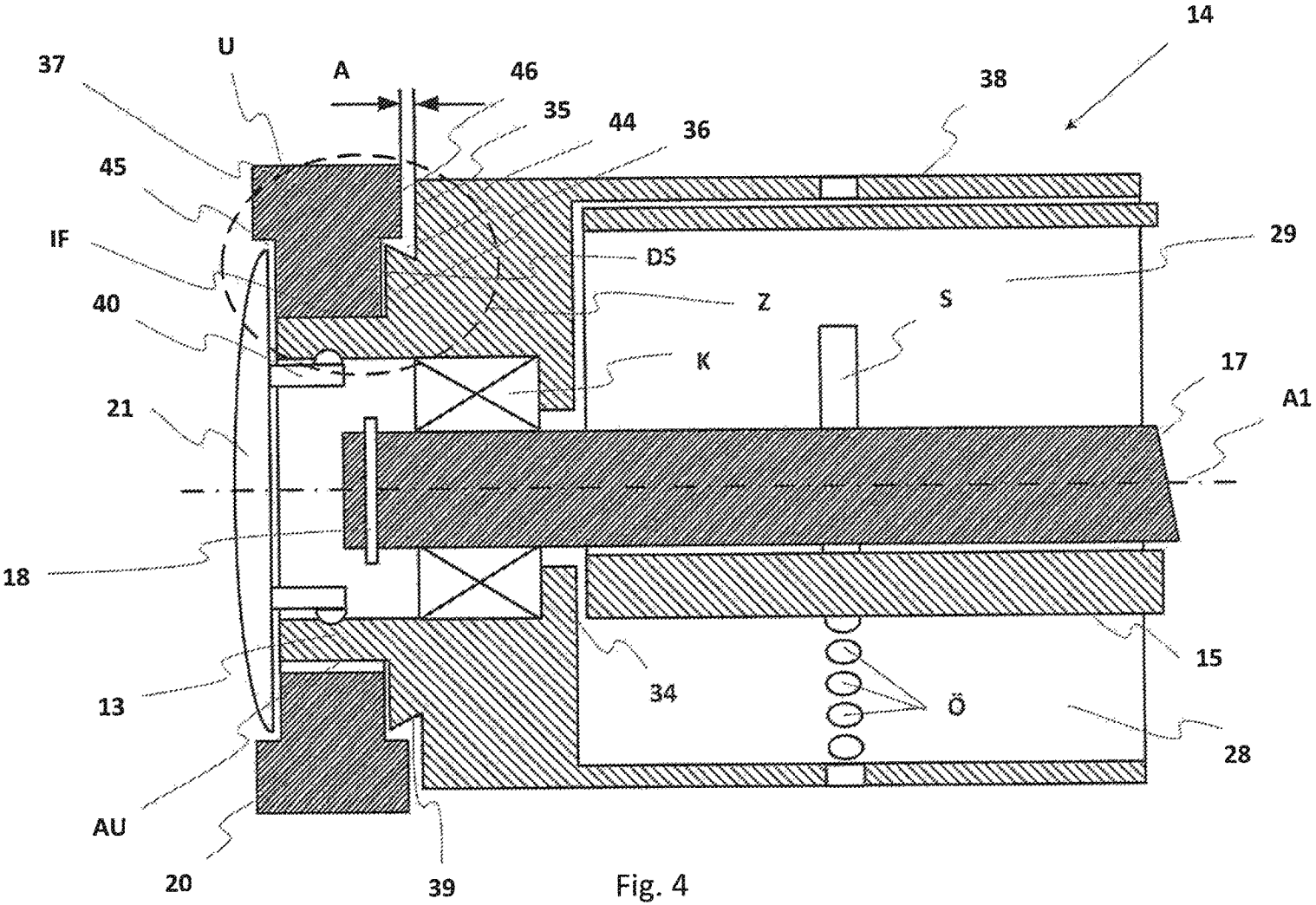
FIG. 4 shows another embodiment of a suction drum and a drive element according to the invention, according to FIG. 3.

FIG. 4 shows another embodiment of a suction drum 14 according to the invention, having a drive element 20. As in the previous exemplary embodiment (FIG. 3), the suction drum 14 is supported in the area of its outer end on a shaft 17 via a bearing K. A retaining ring 18 which prevents the axial displacement of the suction drum 14 during operation is mounted on the shaft 17 for axially fixing the suction drum 14. The suction drum 14 is provided with perforations or openings Ö extending on its periphery 38. A stationarily supported suction insert 15 having a suction slit S on a portion of its periphery is disposed in the interior 28 of the suction drum 14. The suction insert 15 is held in its installed stationary position on a carrier 16 (FIG. 2) via holding means, not shown in greater detail.

In contrast to the exemplary embodiment from FIG. 3, the suction drum 14 has a step-shaped projection 36 between the outer periphery AU of the projection 13 and the end face 35 of the suction drum 14. The surface 39 of the projection 36 directed radially outward from the axis of rotation A1 is conical, and so the outer diameter DE (FIG. 5) of the projection 36 constantly decreases toward the end face 35 of the suction drum 14. The friction wheel 20 is rotationally symmetrical and, on its two sides, has an annular groove 37, 45 which extends radially outward from the inner surface IF of the friction wheel 20. The groove 37, 45 is designed to match the receptacle of the projection 36. The rotationally symmetrical design of the friction wheel 20 prevents incorrect installation of the friction wheel 20.

A closure cap 21 is fastened in the area of the annular projection 13, which closure cap protrudes via its outer diameter into the groove 45 of the friction wheel 20. As is also the case in the exemplary embodiment from FIG. 3, the closure cap 21 is provided with an annular projection 40 which protrudes into the clearance of the annular projection 13 of the suction drum 14. As a result of the closure cap 21, the friction wheel 20 is held in position on the annular projection 13 in the axial direction, wherein in the operating position, an axial gap A forms outside of the projection and the recess. The axial gap A is between 0.1-0.5 mm. A narrow sealing gap DS forms in the area of the seal where the projection 36 and the groove 37 interact. As a result of the sealing gap DS, fibers that pass from the periphery 38 of the suction drum 14 into the gap A are prevented from moving to the outer periphery AU of the projection 13 and settling there.

Figure 5:
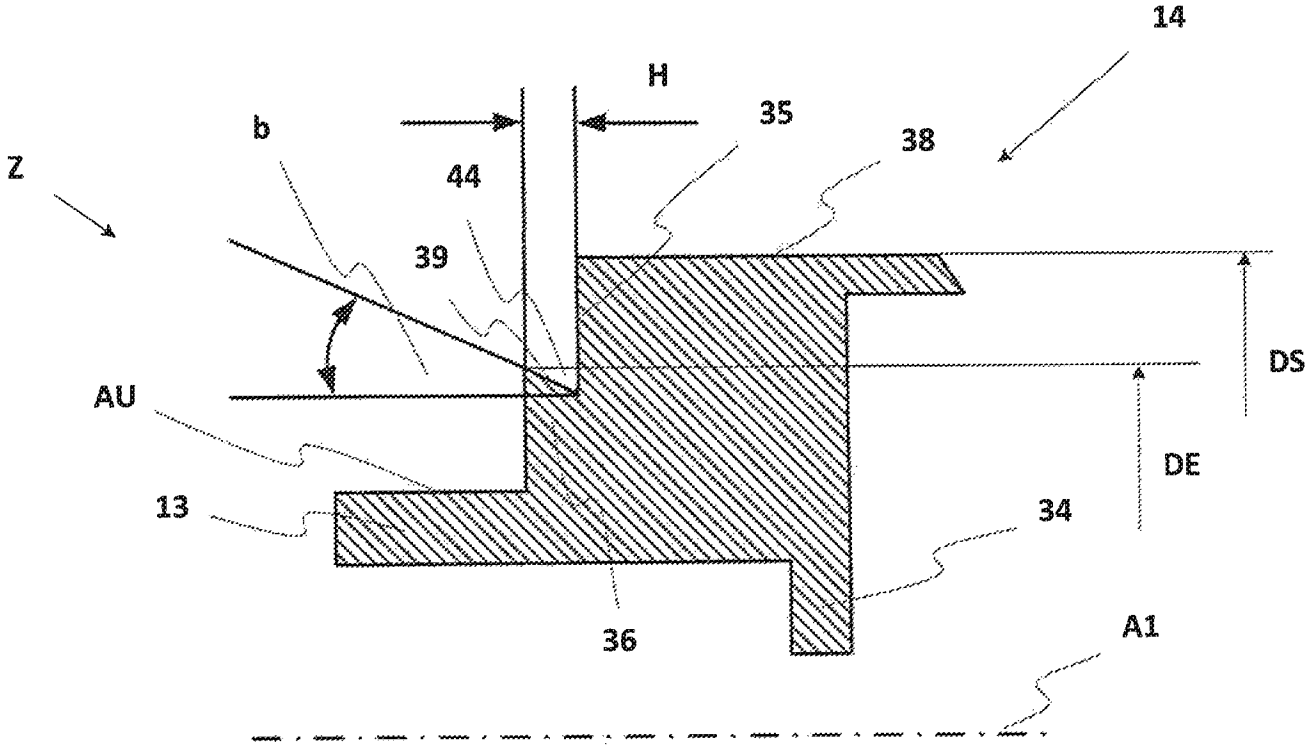
FIG. 5 shows an enlarged partial view Z according to FIG. 4.

An enlarged view of the projection 36 of the suction drum 14 is shown in FIG. 5 (view Z from FIG. 4). The surface 39 of the projection 36 directed radially outward from the axis of rotation A1 is disposed at an angle b of 5-45° with respect to the axis of rotation A1, specifically in such a way that the outer diameter DE of the projection 36 constantly decreases toward the end face 35 of the suction drum 14. As a result of the toothed configuration of the projection 36, a recess 44 forms between the surface 39 of the projection 36 and the end face 35 of the suction drum 14. Fibers that pass from the periphery 38 of the suction drum 14 into the gap A (FIG. 4) can settle in the recess 44. As a result of the recess 44, fibers can be prevented from moving into the area of the outer periphery AU of the projection 13. The maximum outer diameter DE of the projection 36 is between 50-75% of the outer diameter DS of the suction drum 14 (DE=0.5-0.75 DS). The height H of the projection 36 is between 1-5 mm.

Modifications and variations can be made to the embodiments illustrated or described herein without departing from the scope and spirit of the invention as set forth in the appended claims.

The invention claimed is:

1. A rotatable suction drum (14) for a device (VM) for compacting a fiber material (V) on a spinning machine, comprising:

an annular drive element (20);

a projection (13) that extends coaxial to an axis of rotation (A1) of the suction drum (14) from an end face (35) of the suction drum (14), the projection configured so that, in an operating position, a portion of an inner surface (IF) of the annular drive element rests on a portion of a circular peripheral surface (AU) of the projection;

at least one peripheral elevation (36) defined on the end face of the suction drum;

at least one peripheral recess (37) on a side (46) of the annular drive element (20) directed toward the end face (35) of the suction drum (14);

wherein the elevation (36) protrudes into the recess (37), and the elevation (36) and the recess (37) together form a labyrinth seal.

2. The suction drum according to claim 1, wherein the elevation (36) of the suction drum (14) has a height (H) of 1-5 mm.

3. The suction drum according to claim 1, wherein a spacing (A) of 0.1-0.5 mm is defined between the end face (35) of the suction drum (14) and the side (46) of the annular drive element (20) radially outward from the elevation (36) and the recess (37).

4. The suction drum according to claim 1, wherein the elevation (36) comprises a step-shaped projection on the end face (35) of the suction drum (14).

5. The suction drum according to claim 4, wherein a surface (39) of the projection (36) is directed radially outward from the axis of rotation (A1) at an angle (b) of 5-45° with respect to the axis of rotation (A1), and an outer diameter (DE) of the projection (36) constantly decreases toward the end face (35) of the suction drum (14).

6. The suction drum according to claim 1, wherein the annular drive element (20) is rotationally symmetrical.

7. A device (VM) for compacting a fiber material (V) on a spinning machine, comprising a suction drum (14) according to claim 1.

8. A spinning machine, comprising a device (VM) for compacting a fiber material (V) according to claim 7.

* * * * *